US007356868B1

(12) United States Patent
Herrmann

(10) Patent No.: US 7,356,868 B1
(45) Date of Patent: Apr. 15, 2008

(54) MULTI-PURPOSE CLEANING ACCESSORY FOR GOLF EQUIPMENT

(76) Inventor: Thomas A Herrmann, 9199 Barney Rd., Albion, PA (US) 16401

( * ) Notice: Subject to any disclaimer, the term of this patent is extended or adjusted under 35 U.S.C. 154(b) by 0 days.

(21) Appl. No.: 11/737,799

(22) Filed: Apr. 20, 2007

(51) Int. Cl.
*A47L 11/32* (2006.01)

(52) U.S. Cl. ..... 15/106; 15/209.1; 15/160

(58) Field of Classification Search ..... 15/106, 15/145, 210 R, 208, 150, 209.1, 160
See application file for complete search history.

(56) References Cited

U.S. PATENT DOCUMENTS

| | | | | |
|---|---|---|---|---|
| 2,871,499 | A | 2/1959 | Gardner | |
| 3,028,617 | A | 4/1962 | Racina | |
| 3,142,853 | A | 8/1964 | Hensley | |
| 4,464,072 | A * | 8/1984 | Norwell | 401/137 |
| 5,075,918 | A * | 12/1991 | Zeltner et al. | 15/210.1 |
| 5,269,615 | A | 12/1993 | Lewis, Jr. | |
| D350,232 | S | 9/1994 | Stangarone et al. | |
| D350,323 | S * | 9/1994 | Stracuzzi | D12/300 |
| 5,479,674 | A | 1/1996 | Gilcrest | |
| 5,664,277 | A | 9/1997 | Matlock | |
| 5,878,460 | A | 3/1999 | Bruce | |
| 5,898,968 | A | 5/1999 | Beattie | |
| 5,970,561 | A | 10/1999 | Archibeque | |
| 6,010,109 | A * | 1/2000 | Green | 248/694 |
| 6,115,872 | A * | 9/2000 | Welsh | 15/209.1 |
| 6,269,512 | B1 | 8/2001 | Thomson et al. | |
| 6,685,372 | B1 | 2/2004 | Foss et al. | |
| 6,733,016 | B2 | 5/2004 | Chung | |
| 6,745,424 | B1 | 6/2004 | Pimentel et al. | |
| 6,898,817 | B1 | 5/2005 | Jackson | |
| 2003/0084532 | A1 | 5/2003 | Doan | |
| 2004/0211019 | A1 | 10/2004 | Hale | |
| 2005/0205456 | A1 | 9/2005 | Meyer et al. | |

* cited by examiner

*Primary Examiner*—Lee D Wilson
(74) *Attorney, Agent, or Firm*—Wayne L. Lovercheck

(57) ABSTRACT

A multi-purpose golf equipment cleaning accessory releasably attachable to a golf bag or like structure for cleaning club heads, club grips, and golf shoes spikes includes an exterior surface, a first half portion integrally and pivotally adjoined to a second half portion and defining a continuous interior surface whereupon the half portions are opened to a 180 degree orientation for revealing golf equipment cleaning structures that include a golf club head cleaner mounted to the first portion and a golf club grip cleaner integrally attached to the golf club head cleaner into and through which club heads and grips are swiped for cleaning with the second half portion further including a shoe brush on which spiked golf shoe soles are cleaned. The cleaning accessory is attachable to the golf bag by using fastening material extending along the exterior surface of one half portion or by clamps mounted to the first half portion and that are releasably securable to a strap or external surface of the golf bag.

20 Claims, 7 Drawing Sheets

MULTI-PURPOSE CLEANING ACCESSORY FOR GOLF EQUIPMENT

FIELD OF THE INVENTION

The present invention broadly pertains to golf accessory items, and more particularly pertains to a compact, efficient multi-purpose, triple threat golf equipment cleaning accessory for cleaning golf shoes, and the heads and grips of golf clubs.

BACKGROUND OF THE INVENTION

Golf is a game of skill and precision. Amateurs and professionals have analyzed all aspects of the game, from the layout of courses to the construction and arrangement of the dimples on the golf balls, with contemporary analyses favoring the scientific approach. For example, golf club shafts have been improved using composite and synthetic materials; the faces of golf club heads have been improved with new shapes and new materials, and all manner of dimple arrangements have been experimented with and used to improve the flight, trajectory, and accuracy of golf balls upon being struck by the golf clubs.

While modern science has been recruited to improve every aspect as this venerable game (dating back 800 years to the dismal moors of Scotland), all golfers, whether frustrated amateur or prize-winning professional, confront a mundane and perennial problem every time they hit the "links": how to maintain their equipment dirt free and clean. The spiked shoes of the golfer and all the various parts of the golf club—the grip, the shaft, the club head, and the face of the club head (and the score lines on the face of the club head)—must be kept dirt free during and throughout play. Thus, all manner of cleaning expedients have been employed from the common towel to liquid cleaners that are squirted and sprayed onto the equipment and then wiped off. However, golfers are both a meticulous and fussy breed, and will readily try novel accessories to improve their game and maintain their equipment. More significantly, they will promptly stop using any novel and new accessory or item if it proves to be ineffective for the intended purpose.

Thus, the prior art is replete with accessories, items, and devices for cleaning golf balls, the various parts of the golf club, and the spiked golf shoes. For example, the following prior art pertains to devices that are attachable to golf bags or golf bag pull carts: the Doan Patent Publication No. 2003/0084532); the Corcoran U.S. Design Pat. 339,496; the Lewis et al. U.S. Design Pat. 339,473; the Stangarone et al. U.S. Design Patent 350,232; the Petrie U.S. Design Pat. 386,847; the Jones U.S. Design Patent 426,606; the Gardner U.S. Pat. No. 2,871,499); the Carnahan U.S. Pat. No. 4,350,457; the Norwell U.S. Pat. No. 4,464,072; the Wyckoff et al. U.S. Pat. No. 4,821,358; the Zeltner U.S. Pat. No. 4,912,800; the Johnson et al. U.S. Pat. No. 5,230,117; the Moultrie U.S. Pat. No. 5,555,589; the Jones U.S. Pat. No. 5,815,873; the Bruce U.S. Pat. No. 878,460; the Beattie U.S. Pat. No. 5,898,968; the Trummer U.S. Pat. No. 5,915,432; the Chung U.S. Pat. No. 6,733,016; and, the Pimentel et al. U.S. Pat. No. 6,745,424.

More specifically, the following prior art pertains to tubular or sleeve-like golf club head and grip cleaners that are attachable to golf bags, golf carts, and golf bag pull carts: the Hale U.S. Patent Publication No. 2004/0211019; the Meyer U.S. Patent Publication No. 2005/0205456; the Fattal U.S. Pat. No. 4,923,316; the Rivers U.S. Pat. No. 4,953,999; the Lewis U.S. Pat. No. 5,269,615; the Matlock U.S. Pat. No. 5,664,277; the Thomson et al. U.S. Pat. No. 6,269,512; and the Foss et al. U.S. Pat. No. 6,685,372.

The following prior art pertains to devices for cleaning golf shoes and/or golf spikes: the Owens U.S. Design Pat. 420,184; the Racina U.S. Pat. No. 3,028,617; the Hensley U.S. Pat. No. 3,142,853; the Frazelle et al. U.S. Pat. No. 3,350,736; the Kozub U.S. Pat. No. 3,747,150; the Chang et al. U.S. Pat. No. 4,945,596; the Gilcrest U.S. Pat. No. 5,479,674; the Archibeque U.S. Pat. No. 5,970,561; and, the Jolly U.S. Pat. No. 6,256,830.

Finally, the Moore U.S. Pat. No. 5,133,395 and the Jackson U.S. Pat. No. 6,898,817 disclose general scraper and protector devices.

Nonetheless, despite the ingenuity of the array of above-mentioned devices and items, there remains a need for a lightweight, portable, durable, easy to attach and detach multi-purpose golf equipment cleaning accessory that improves and enhances the golfer's game by maintaining his or her equipment in a clean, dirt free condition.

SUMMARY OF THE INVENTION

The present invention comprehends a multi-purpose golf equipment cleaning accessory that is easily and quickly attachable to and detachable from a golf bag or a golf bag pull cart for cleaning the golf equipment such the grip and head of a golf club and the spiked soles of a golf shoe. The golf equipment cleaning accessory is lightweight, durable, manufactured from weather resistant material and can be easily disposed for use and then closed up for transport and/or storage.

The multi-purpose cleaning accessory includes a first half portion integrally and pivotally secured to a second half portion, and both half portions define a continuous exterior surface or side and an opposite continuous interior surface or side. The interior side of the cleaning accessory includes a peripheral edge, with the peripheral edge further defined by a continuous zipper and zipper catch. When it is desired to close the cleaning accessory the first and second half portions are brought together to allow the zipper catch to be pulled about the entire peripheral edge thereby zipping the first and second half portions together; and the zipper catch is unzipped for allowing the first and second half portions to pivotally open up to expose the various cleaning structures that are used to clean the parts of the golf club and the spiked soles of the golf shoe. When the first and second half portions are zipped together they enclose and define an interior compartment that contains the cleaning structures.

The multi-purpose cleaning accessory includes at least three separate cleaning structures or members all of which are integrally mounted to the interior surface of the cleaning accessory. More specifically, a golf club head cleaner is centrally mounted to the interior surface at the first half portion, and the golf club head cleaner includes a pocket open at both ends. The pocket includes a continuous interior surface and mounted to the interior surface is a brush comprised of brush bristles. The head cleaner brush extends completely about the interior surface so that the brush surrounds the golf club head when the golf club head is inserted into the pocket for cleaning.

Centrally and integrally mounted to the golf club head cleaner is a pliable golf club grip cleaner. The golf club grip cleaner includes a pair of half portions that are longitudinally closed together to form an interior grip cleaner aperture that is longitudinally coextensive with the half portions. When secured together the half portions form an interior annular material surface that is preferably includes or is composed of a fabric material such as the fabric commonly known as terry cloth. The grip of the golf club is inserted into the interior grip cleaner aperture so that the grip can be wiped clean by rubbing against the fabric material by a back-and-forth motion.

Disposed on the interior surface of the second half portion is a golf shoe cleaner structure that more specifically is shoe brush composed of a plurality of individual resistive bristles that remove dirt; debris, and other material when the spiked sole of a golf shoe is swiped or rubbed with a back-and-forth motion against the bristles of the shoe brush. The shoe brush is located immediately inboard of the peripheral edge and the continuous zipper, and substantially covers the interior surface of the second half portion.

The multi-purpose cleaning accessory is attachable to the golf bag or golf bag pull cart by various structures with two primary methods of attachment including at least one strip of hook and loop fastening material secured to the exterior surface opposite the first half portion and adjacent the peripheral edge whereupon the fastening material is pressed against the surface of the golf bag for adherence thereto. A second method of attachment is through at least two clamps secured in spaced relation to the exterior surface at the first half portion and adjacent the peripheral edge, with each clamp having opposable jaws that can be opened and closed upon the external surface of the golf bag or can be secured to a strap of the golf bag. A loop attached to the second half portion adjacent the peripheral edge allows the golfer to easily carry and transport the cleaning accessory when both half portions are zipped together.

It is an object of the present invention to provide a multi-purpose golf equipment cleaning accessory that is lightweight, portable, durable and usable in various outdoor weather conditions and environments.

It is another object of the present invention to provide a multi-purpose golf equipment cleaning accessory that is easily and quickly attachable to a golf bag for use and detachable therefrom for storage and transport.

It is yet another object of the present invention to provide a multi-purpose golf equipment cleaning accessory that is relatively simple to manufacture and inexpensive for use by both amateur and professional golfers.

It is still yet another object of the present invention to provide a multi-purpose golf equipment cleaning accessory wherein the separate cleaning functions of the accessory do not interfere with each other.

These and other objects, features, and advantages will become apparent to those skilled in the art upon a perusal of the following detailed description read in conjunction with the accompanying drawings and appended claims.

DETAILED DESCRIPTION OF THE PREFERRED EMBODIMENT

Figure 1:
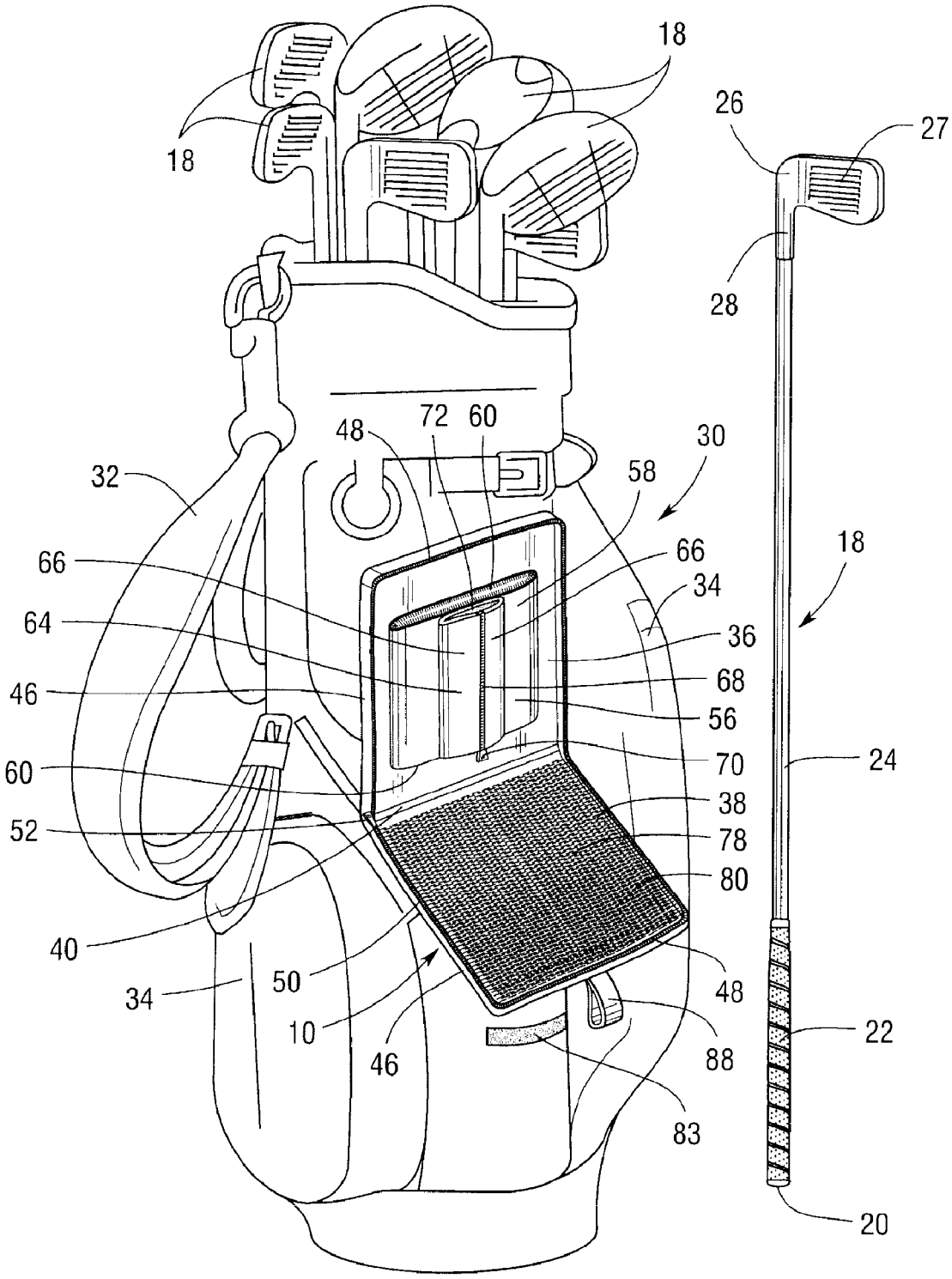
FIG. 1 is a perspective view of the multi-purpose golf equipment cleaning accessory of the present invention showing the cleaning accessory attached to a golf bag with the accessory opened up to reveal the various cleaning structures.
Figure 2:
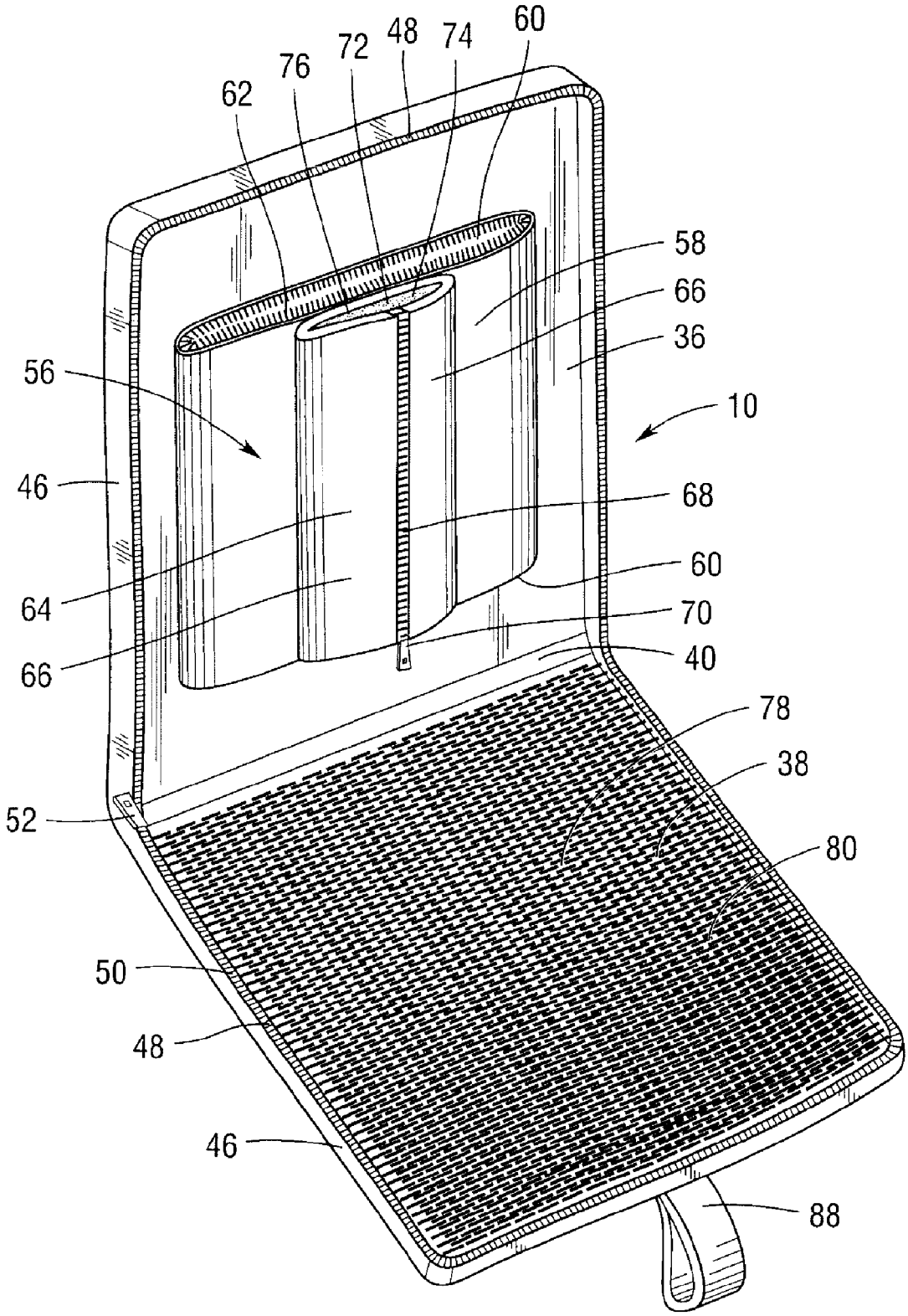
FIG. 2 is a perspective view of the multi-purpose golf equipment cleaning accessory of the present invention unzipped and opened up to reveal the various cleaning structures.
Figure 3:
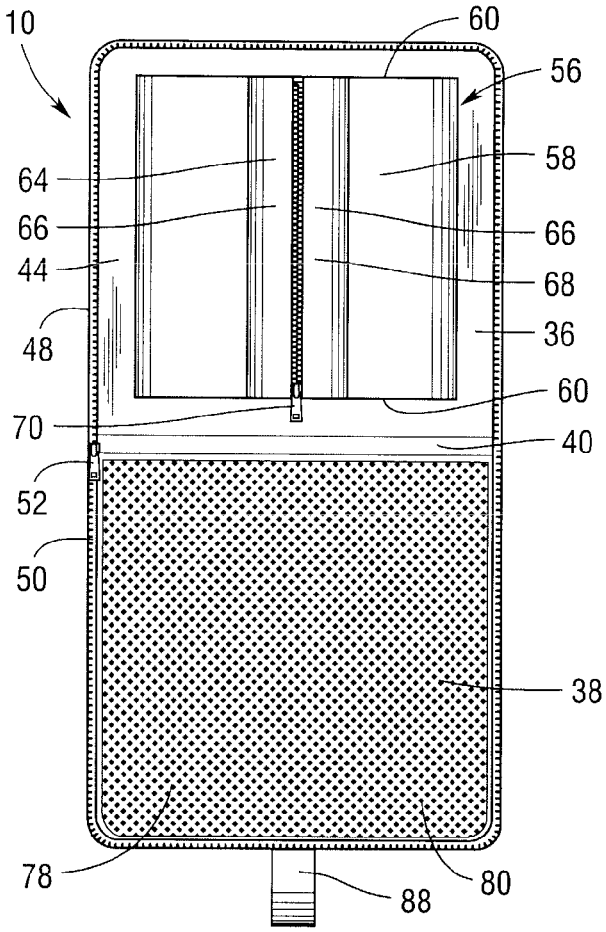
FIG. 3 is a front elevational view of the multi-purpose golf equipment cleaning accessory of the present invention fully unzipped and opened up.

Illustrated in FIGS. 1 through 10 is a lightweight, portable, durable, weather resistant (vinyl plastic, etc.), multi-purpose golf equipment cleaning accessory 10 for cleaning and maintaining clean and dirt free various equipment and items used by both amateur and professional golfers. The primary items and equipment include the spikes 12 on the soles 14 of a golf shoe 16, such as golf shoe 16 shown in FIG. 1, and golf clubs 18 shown in FIGS. 1 and 6 through 10. Each golf club 18 includes a cap 20, a grip or grip portion 22 that is the portion about which the golfer places his or her hands, an elongated shaft 24, a head 26, a face 27 having spaced grooves or striations, and a neck 28 that interconnects shaft 24 to golf club head 26. The primary structures to which cleaning accessory 10 of the present invention is releasably attachable are golf bags and golf bag pull carts, and for representative purposes cleaning accessory 10 will be hereinafter described as being attachable to golf bag 30 as shown in FIGS. 1 and 6 through 8. Golf bag 30 includes a carrying strap 32 and various compartments 34 for holding such things as personal items, scoring sheets, gloves, etc.

Figure 4:
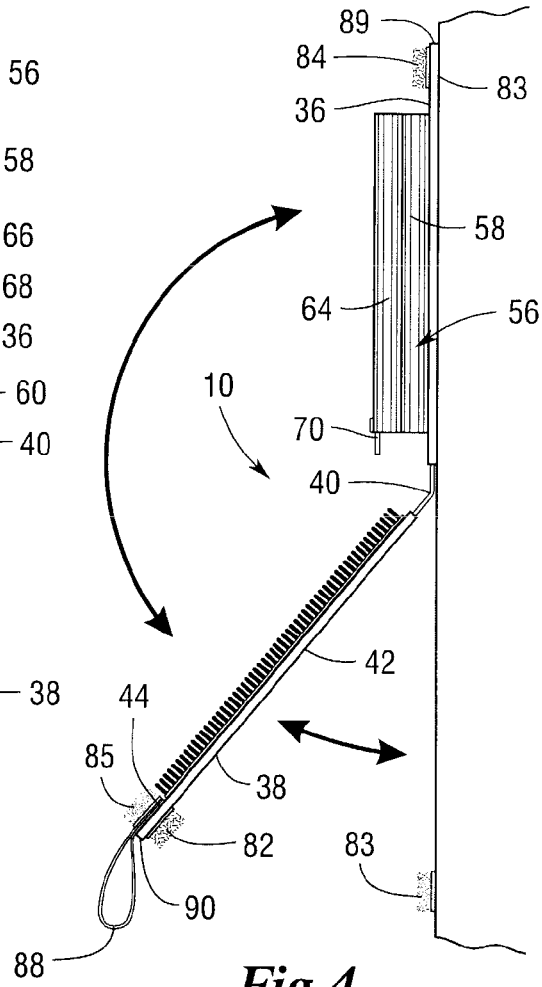
FIG. 4 is a side elevational view of the multi-purpose golf equipment cleaning accessory of the present invention showing the attachment of the first half portion to the golf bag and the range of pivotal motion of the second half portion which includes the shoe cleaner.
Figure 5:
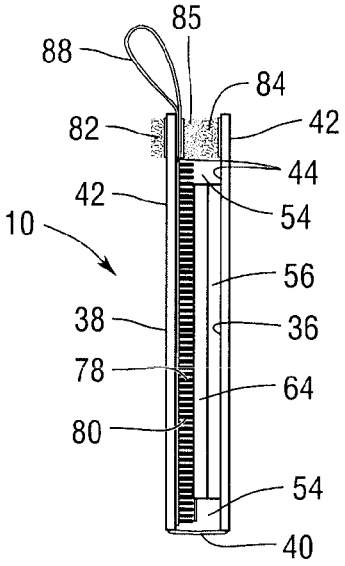
FIG. 5 is a side elevational view of the multi-purpose golf equipment cleaning accessory of the present invention shown in the closed disposition and a strip of fastening material located on the exterior surface thereof for adherence to the golf bag.
Figure 5A:
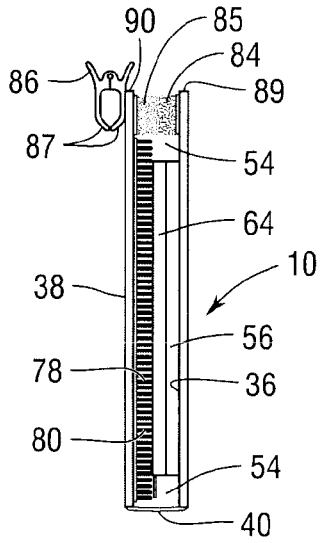
FIG. 5A is a side elevational view of the multi-purpose golf equipment cleaning accessory of the present invention shown in the closed disposition with one attachment clamp being mounted to the exterior surface thereof for providing an alternative way to secure the cleaning accessory to the golf bag.

Cleaning accessory 10 is foldable to a non-use position and unfoldable and openable to a use disposition. Thus, as shown in FIGS. 1 through 8, cleaning accessory 10 includes a first half portion 36 and a second half portion 38. Both half portions 36 and 38 are of the same dimensions so that they mate and cleanly fold together for closure and first and second half portions 36 and 38 are integrally and pivotally adjoined to each other along a flexible folding portion 40. As shown in FIG. 4, the range of pivotal movement or angular orientation of half portions 36 and 38 from each other ranges between zero and 180 degrees—the 180 degrees being attained when cleaning accessory 10 is opened to the use position and laid against and attached to golf bag 30 for use. First and second half portions 36 and 38 define a continuous exterior side or surface 42 and an opposite continuous interior side or surface 44 with golf equipment or paraphernalia cleaning structures hereinafter described located on interior surface 44. A continuous lip 46 that circumscribes first and second half portions 36 and 38 defines a peripheral edge 48, and a closure means is located along peripheral edge 48, with the preferred closure means being a zipper 50 and mating zipper latch 52. Zipper 50 is coextensive with peripheral edge 48, and when half portions 36 and 38 are folded together to the non-use disposition, as shown in FIGS. 5 and 5A, zipper latch 52 is pulled or drawn along zipper 50 for closing cleaning accessory 10. When cleaning accessory 10 is closed and zipped shut, as shown in FIGS. 5 and 5A, an interior compartment 54 is defined wherein the several cleaning structures are contained.

Figure 9:
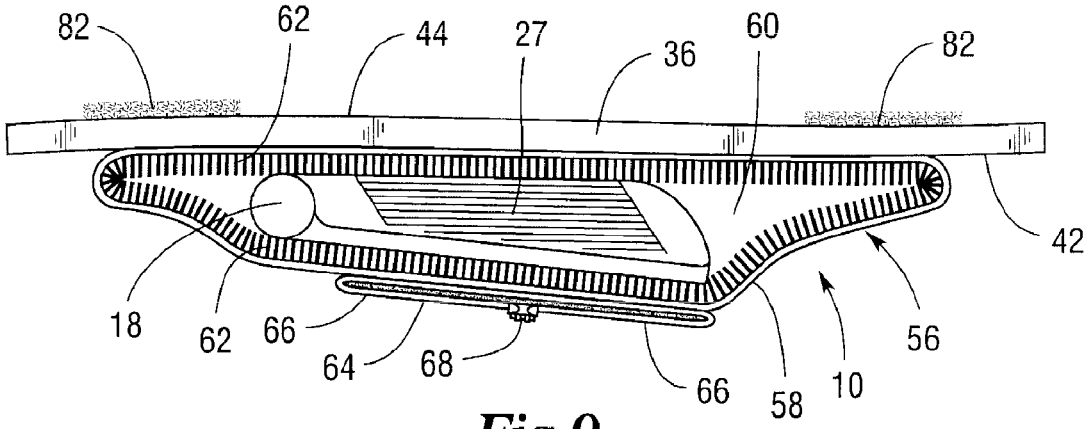
FIG. 9 is a top plan view of the multi-purpose golf equipment cleaning accessory of the present invention illustrating the disposition of the head of the golf club within the golf club head cleaner structure for cleaning thereof.

Cleaning accessory 10 can be considered a compact and efficient triple threat cleaner because it includes a plurality of integral cleaning structures, and preferably three cleaning structures as illustrated in FIGS. 1 through 10. Thus, as shown in FIGS. 1 through 4 and 6 through 10, one cleaning structure is a golf club head cleaner 56 centrally located on interior surface 44 of first half portion 36. Golf club head cleaner 56 includes a longitudinal pocket 58 having opposed openings 60 or which is open at both ends thereof. The interior surface of golf club head cleaner 56 completely circumscribes pocket 58, and mounted to interior surface of pocket 58 are golf club head cleaning bristles 62. Golf club head cleaning bristles 62 project into pocket 58 and are slightly resistive so that dirt and debris is swept off head 26 of golf club 18 when golf club 18 is inserted into pocket 58 and then swiped with a back-and-forth or reciprocal motion against head cleaning bristles 62. Head cleaning bristles 62 essentially surround head 26 of golf club 18, as shown in FIG. 9, so that dirt is simultaneously removed from both face 27 and the other portions of golf club head 26. Pocket 58 of golf club head cleaner 56 is sized to receive therein all sizes and dimensions of golf club heads currently in use in the sport.

Figure 6:
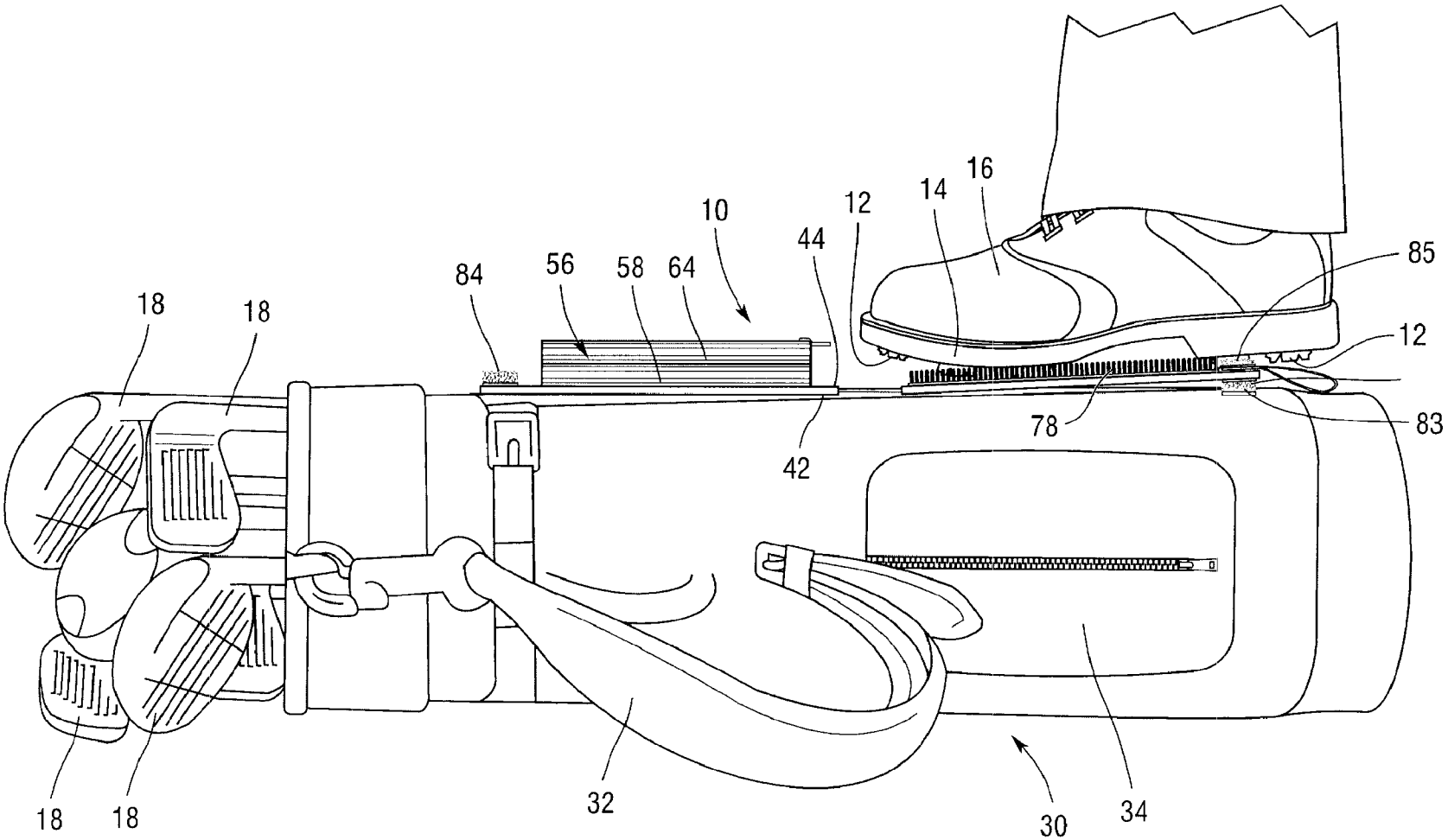
FIG. 6 is a side elevational view of the multi-purpose golf equipment cleaning accessory of the present invention showing the cleaning accessory attached to the golf bag and fully opened up so that a golfer can clean his golf shoe on the golf shoe cleaner structure.
Figure 7:
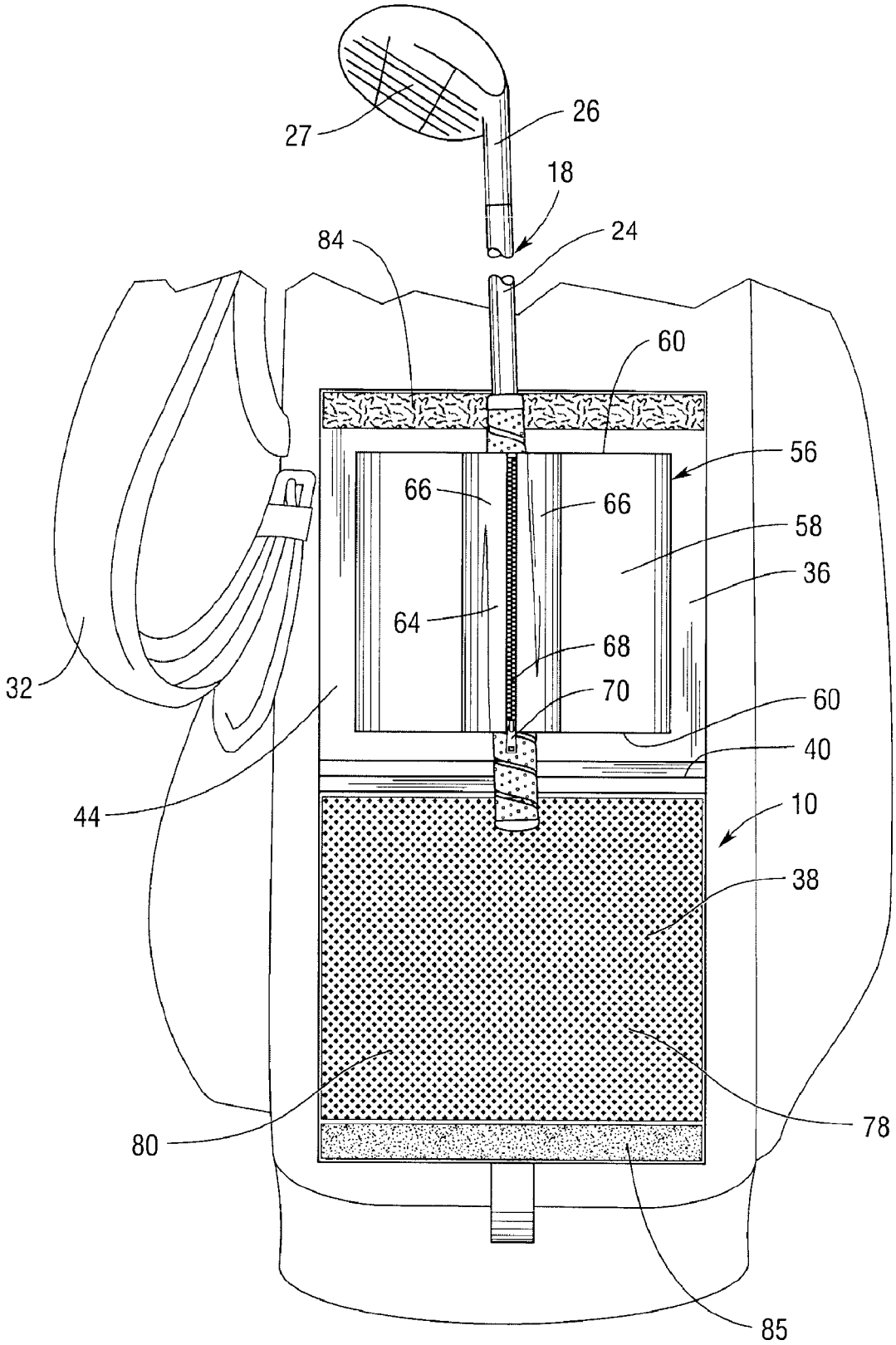
FIG. 7 is a front elevational view of the multi-purpose golf equipment cleaning accessory of the present invention illustrating the grip of the golf club being cleaned by moving the grip in a back and forth motion within the golf club grip cleaner structure.
Figure 8:
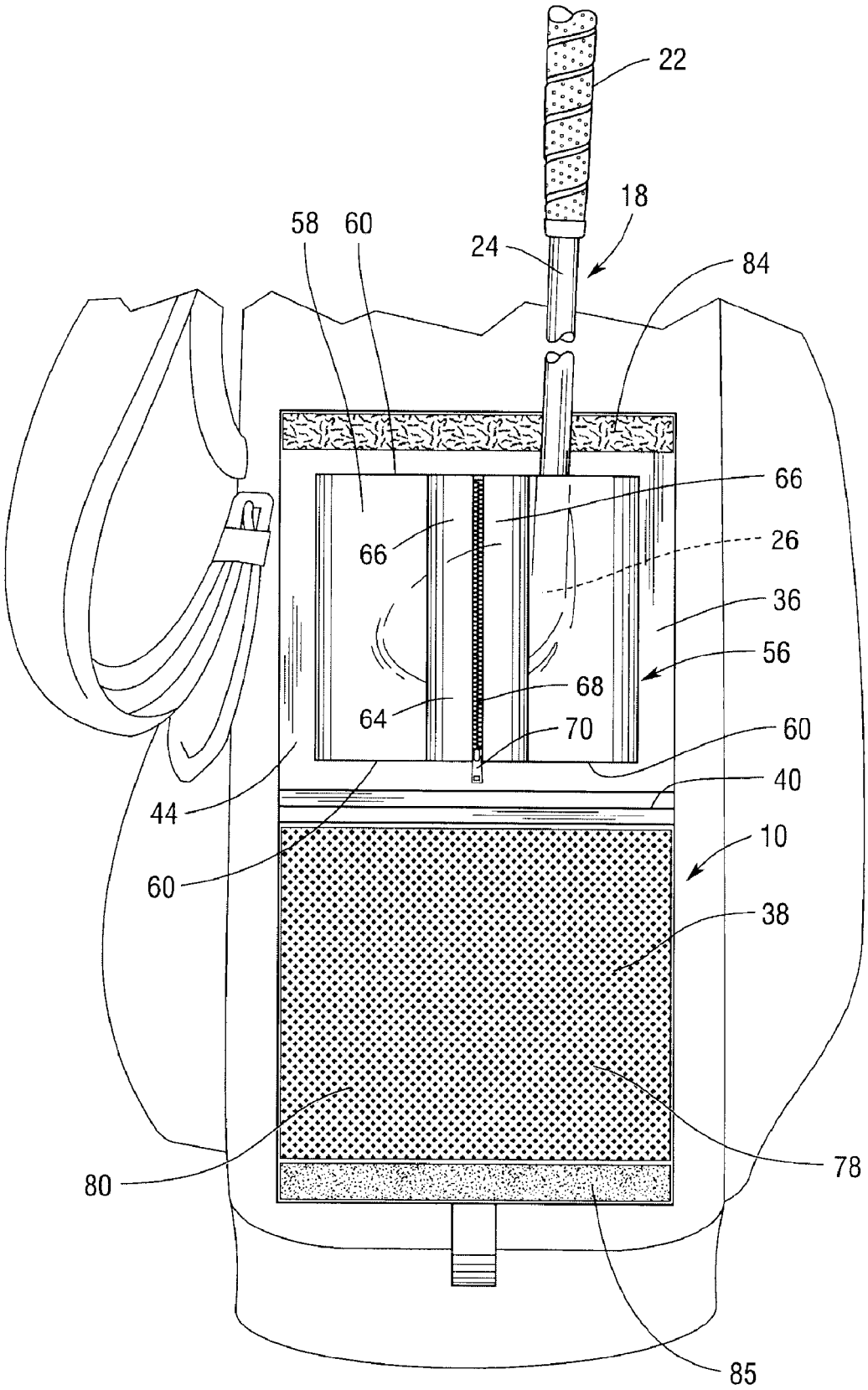
FIG. 8 is a front elevational view of the multi-purpose golf equipment cleaning accessory of the present invention illustrating the head of the golf club being cleaned by the golf club head cleaner structure.
Figure 10:
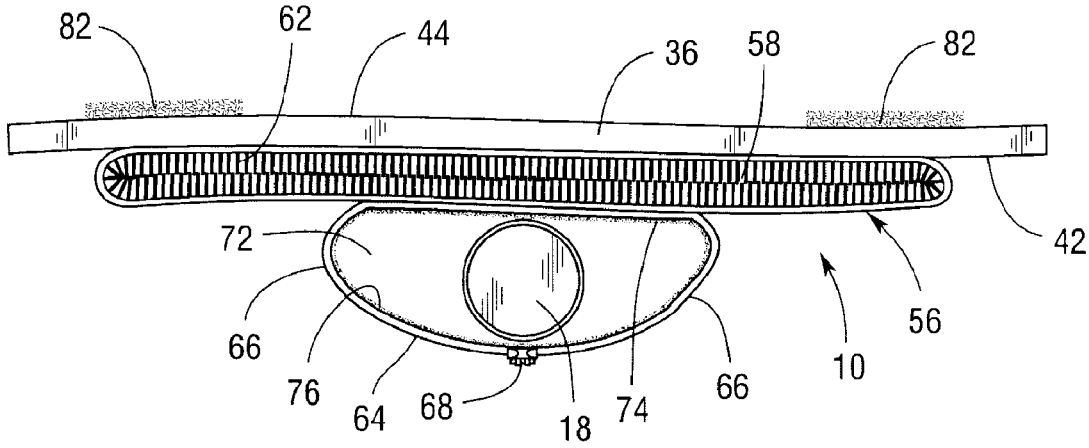
FIG. 10 is a top plan view of the multi-purpose golf equipment cleaning accessory of the present invention illustrating the disposition of the grip of the golf club within the golf club grip cleaner structure for cleaning thereof.

As illustrated in FIGS. 1 through 4 and 6 through 10, a second golf equipment cleaning structure is a golf club grip cleaner 64 centrally located on and mounted to the exterior surface of pocket 58 of golf club head cleaner 56. Golf club grip cleaner 64 is pliant and includes two half portions 66 securable to each other by any conventional means such as by a longitudinally extending zipper 68 and accompanying zipper latch 70. When secured together grip cleaner half portions 66 define and form an interior grip cleaner aperture 72 longitudinally coextensive with half portions 66. Golf club grip cleaner 64 also includes an interior generally continuous annular surface 74 that circumscribes interior grip cleaner aperture 72, and interior annular surface 74 is lined with or has fastened and secured thereto a cleaning fabric material 76 such as the fabric material have the common trade name terry cloth. Cleaning fabric material 76 is generally coextensive with interior annular surface 74 of golf club grip cleaner 64. As shown in FIGS. 7 and 10, grip 22 of golf club 18 is inserted into interior grip cleaner aperture 72 and then moved in a reciprocating or back and forth motion (or up and down depending on the orientation of golf bag 30 and attached cleaning accessory 10) against the surrounding fabric material 76 thereby causing the removal of dirt and debris from grip 22 and cleaning grip 22 of golf club 18. Because golf club grip cleaner 64 is comprised of two detachable and securable half portions 66, fabric material 76 can be removed and replaced when it becomes soiled and loses its effectiveness. It should also be noted that when cleaning accessory 10 is attached to golf bag 30, as shown in FIGS. 1 and 6 through 8, golf club grip 22 will not interfere with or be obstructed by the other cleaning structures when golf club grip 22 is being moved back-and-forth within interior grip cleaner aperture 72 of grip cleaner 64 for cleaning as golf club grip cleaner 64 is positioned outboard of golf club head cleaner 56. In effect, golf club grip cleaner 64 forms a holster on golf club head cleaner 56.

As shown in FIGS. 1, 2, 4, and 6, a third cleaning structure is located on interior surface 44 of second half portion 38 and is a golf shoe cleaner structure comprised of a golf shoe brush pad 78 composed of a plurality of individual resistive bristles 80. Shoe brush pad 78 substantially covers interior surface 44 at second half portion 38 but doesn't interfere with the closure and securement of half portions 36 and 38 to each other as shown in FIGS. 5 and 5A. Spikes 12 of golf shoe 16 arc cleaned by swiping or rubbing spikes 12 on sole 14 of golf shoe 16 back-and-forth against resistive—generally hard rubber—bristles 80 of shoe brush pad 78 as shown in FIG. 6.

Cleaning accessory 10 includes several releasably attachable means for mounting cleaning accessory 10 to the exterior surface of golf bag 30, to one compartment 34 or strap 32 of golf bag 30, or to other structure on, for example, a part of a golf bag pull cart or golf cart. As shown in FIG. 5 one preferred attachment means includes at least one fastening material strip or member 82 secured to exterior surface 42 of first half portion 36 at an upper edge that is defined when cleaning accessory 10 is mounted to golf bag 30 in the orientation shown in FIGS. 1 and 7. Fastening strip material 82 could also be placed on exterior surface 42 adjacent the lower edge of second half portion 38 as shown in FIG. 4 (a corresponding piece of fastening material would also be placed at the appropriate location on golf bag 30 for fastening material 82 to releasably attach to as shown in FIG. 4). Fastening material strip or member 82 can be of the hook and loop fastening material known by the trade name VELCRO®. At least one corresponding piece of strip material 83 would be secured to golf bag 30 for receiving holding fastening material strip 82 to some portion of the exterior surface of golf bag 30.

As an alternative to zipper 50, the closure could be accomplished with a similar fastening strip material 84 placed on interior surface 44 at distal end 89 of first half portion 36, and a corresponding fastening strip material 85 placed on interior surface 44 at distal end 90 of second half portion 38.

In addition, shown in FIG. 5A is a second preferred embodiment of a releasably attachable means for securing cleaning accessory 10 to golf bag 30, golf bag pull cart, or an appropriate part or structure on the golf cart. Shown in FIG. 5A is a clamp 86 (two clamps are desirable for proper securement) having opposable jaws 87 that are manually clamped onto the desired part or location of golf bag 30. One of jaws 87 for each clamp 86 is secured to exterior surface 42 of cleaning accessory 10 adjacent the upper edge of first half portion 36 and is therefore non-movable with the other jaw 87 capable of pivoting toward or away from non-movable jaw 87 for securement or release of clamp 86—and thus cleaning accessory 10—to or from golf bag 30. Finally, attached to and extending outwardly from peripheral edge 48 at the bottom of second half portion 38 when cleaning accessory 10 is mounted to and oriented on golf bag 30 as shown in FIGS. 1 and 7, is a carrying loop 88. When both half portions 36 and 38 are zipped together for closing cleaning accessory 10 as shown in FIGS. 5 and 5A, the golfer can easily slip a finger through carrying loop 88 and manually carry cleaning accessory 10 by his or her hand if golfer so desires.

It is obvious that numerous modifications, alterations, and variations may be made in the form and construction of the invention by those skilled in the art without departing from the spirit and scope of the invention, and thus it is not desired to circumscribe the invention to the exact form herein described, but it is desired to include all such modifications, alterations, and variations as properly come within the scope of the invention as claimed hereinafter.

I claim:

1. A multi-purpose golf club and golf shoe cleaning accessory, comprising:

a first half portion;

a second half portion pivotally adjoined to the first half portion;

a continuous exterior surface extending along the first half portion and the second half portion;

a continuous interior surface opposite the continuous exterior surface and extending along the first half portion and the second half portion;

a golf club head cleaner open at one end and mounted to the interior surface of the first half portion for cleaning the golf club head of the golf club;

a golf club grip cleaner open at both ends and positioned outboard of and mounted to the golf club head cleaner for cleaning the golf club grip of the golf club; and, a shoe brush pad mounted to the interior surface adjacent the second half portion for cleaning the sole of the golf shoe.

2. The cleaning accessory of claim 1 wherein pivoting the second half portion at least 180 degrees from the first half portion disposes the golf club head cleaner, the golf club grip cleaner, and the shoe brush pad to the use position and closing the second half portion on the first half portion disposes the golf club head cleaner, the golf club grip cleaner, and the shoe brush pad to the non-use disposition.

3. The cleaning accessory of claim 2 further comprising a continuous peripheral edge that extends about the first half portion and the second half portion.

4. The cleaning accessory of claim 3 further comprising a zipper and a mating zipper latch located on the peripheral edge and continuously extending about the first half portion and the second half portion.

5. The cleaning accessory of claim 4 wherein pivoting the second half portion adjacent to the first half portion allows for the zipper latch to engage the zipper for securing the first and second half portions to each other and enclosing therebetween the golf club head cleaner, the golf club grip cleaner, and the shoe brush pad.

6. The cleaning accessory of claim 5 further comprising a carrying loop mounted to the second half portion and laterally extending therefrom for allowing a golfer to carry and transport the cleaning accessory by the carrying loop.

7. The cleaning accessory of claim 6 wherein the golf club grip cleaner is centrally located on the golf club head cleaner so that cleaning the golf club grip doesn't interfere with the shoe brush pad.

8. A portable multi-purpose golf equipment cleaning accessory for cleaning a grip and a club head of a golf club and the spiked sole of golf shoe, comprising:

a first half portion;

a second half portion pivotally adjoined to the first half portion;

a golf club head cleaner mounted to the first half portion and having a pocket for inserting therein the club head for cleaning;

a golf club grip cleaner centrally located on and mounted to the golf club head cleaner and having an interior grip cleaner aperture for inserting therein the grip of the golf club for cleaning;

a shoe brush pad mounted to the second half portion for cleaning the spiked sole of the golf shoe; and, releasably attachable means for mounting the cleaning accessory to a golf bag.

9. The cleaning accessory of claim 8 further comprising a plurality of golf club head cleaning bristles mounted within the pocket of the golf club head cleaner and engaging the club head thereby removing dirt and debris from the club head when the club head is moved with a back-and-forth motion against the golf club head cleaning bristles.

10. The cleaning accessory of claim 9 wherein a cleaning fabric material surrounds the interior grip cleaner aperture and is contacted by the grip of the golf club so that the grip can be cleaned by moving the grip in a back-and-forth motion against the cleaning fabric material.

11. The cleaning accessory of claim 10 wherein the first half portion and the second half portion define a continuous exterior surface and an opposite continuous interior surface with the golf club head cleaner, the golf club grip cleaner, and the shoe brush pad being mounted to the continuous interior surface.

12. The cleaning accessory of claim 11 wherein the releasably attachable means for mounting the cleaning accessory to the golf bag includes at least one fastening strip member mounted to the continuous exterior surface adjacent the first half portion.

13. The cleaning accessory of claim 12 wherein the releasably attachable means for mounting the cleaning accessory to the golf bag includes a pair of clamps mounted to the continuous exterior surface adjacent the first half portion and that are capable of selective attachment to the golf bag and release therefrom.

14. The cleaning accessory of claim 13 further comprising a carrying loop mounted to the second half portion and laterally extending therefrom so that a golfer can carry and transport the cleaning accessory by the carrying loop.

15. A portable multi-purpose golf equipment cleaning accessory for attachment to a golf bag for cleaning a golf club grip and a golf club head of a golf club, comprising:

a first half portion;

a second half portion pivotally connected to the first half portion;

a golf club head cleaner mounted to the first half portion and having a pocket into which the golf club head is inserted for cleaning;

the golf club head cleaner having a pocket that defines an interior surface having a plurality of head cleaning bristles mounted thereto, head cleaning bristles contacting the golf club head for removing dirt and debris therefrom;

a golf club grip cleaner centrally located on the golf club head cleaner and defining an interior grip cleaner aperture and a cleaning fabric material lining the grip cleaner aperture whereupon insertion of the golf club grip into the grip cleaner aperture and moving the golf club grip against the cleaning fabric material results in the removal of dirt and debris from the golf club grip; and a shoe brush pad mounted to the second half portion for cleaning the spiked sole of the golf shoe.

16. The cleaning accessory of claim 15 further comprising a releasably attachable means for mounting the cleaning accessory to the golf bag.

17. The cleaning accessory of claim 16 wherein the releasably attachable means for mounting the cleaning accessory to the golf bag includes at least one fastening strip member mounted to the first half portion for attachment to and detachment from the golf bag.

18. The cleaning accessory of claim 17 wherein the releasably attachable means for mounting the cleaning accessory to the golf bag includes a pair of clamps mounted to the first half portion and which are capable of attachment to the golf bag and detachment therefrom.

19. The cleaning accessory of claim 18 further comprising a carrying loop mounted to the second half portion and laterally extending therefrom so that a golfer can carry and transport the cleaning accessory by the carrying loop.

20. A multi-purpose golf club and golf shoe cleaning accessory, comprising:

a first half portion;

a second half portion pivotally adjoined to said first half portion;

a continuous exterior surface extending along said first half portion and said second half portion;

a continuous interior surface opposite said continuous exterior surface and extending along said first half portion and said second half portion;

a golf club head cleaner mounted to the interior surface of said first half portion for cleaning a golf club head of said golf club;

a golf club grip cleaner is positioned outboard of centrally located on, and mounted to said golf club head cleaner for cleaning said golf club grip of said golf club;

a shoe brush pad mounted to the interior surface adjacent said second half portion for cleaning the sole of said golf shoe;

a zipper and a mating zipper latch located on a continuous peripheral edge;

said zipper, said zipper latch and said peripheral edge continuously extending about said first half portion and said second half portion.

* * * * *